US010186099B2

(12) United States Patent
Ahearn et al.

(10) Patent No.: US 10,186,099 B2
(45) **Date of Patent: *Jan. 22, 2019**

(54) USAGE OF GPS ON DOOR SECURITY

(71) Applicant: Schlage Lock Company LLC, Carmel, IN (US)

(72) Inventors: John R. Ahearn, Pasadena, CA (US); Joseph W. Baumgarte, Carmel, IN (US); Gabriel D. Focke, Sunman, IN (US); Michael S. Henney, Indianapolis, IN (US)

(73) Assignee: Schlage Lock Company LLC, Carmel, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/363,807

(22) Filed: Nov. 29, 2016

(65) Prior Publication Data

US 2017/0148244 A1 May 25, 2017

Related U.S. Application Data

(63) Continuation of application No. 13/968,669, filed on Aug. 16, 2013, now Pat. No. 9,508,206.
(Continued)

(51) Int. Cl.
*G08C 19/00* (2006.01)
*G07C 9/00* (2006.01)

(52) U.S. Cl.
CPC ..... *G07C 9/00309* (2013.01); *G07C 9/00174* (2013.01); *G07C 2009/0042* (2013.01);
(Continued)

(58) Field of Classification Search
None
See application file for complete search history.

(56) References Cited

U.S. PATENT DOCUMENTS 5,319,362 A * 6/1994 Hyatt, Jr. ..... G07C 9/00015 235/382.5
6,005,306 A * 12/1999 Pickard ..... E05B 47/0047 307/117
(Continued)

FOREIGN PATENT DOCUMENTS

EP 2364006 A1 9/2011
JP 2009127336 A * 6/2009
(Continued)

OTHER PUBLICATIONS

European Search Report; European Patent Office; European Patent Application No. 13829775.9; dated Apr. 4, 2016; 6 pages.
(Continued)

*Primary Examiner* — Adnan Aziz
(74) *Attorney, Agent, or Firm* — Taft Stettinius & Hollister LLP

(57) ABSTRACT

A lock system including an electronic lock and a wireless device having a location determining utility configured to determine a location of the wireless device. The electronic lock and the wireless device communicate wirelessly with one another and send commands to and from one another to perform a specific task when the wireless device is within a specified range of the electronic lock. The location of the wireless device and a speed of the wireless device may be used to calculate an estimated arrival of the wireless device at the electronic lock, and the specific task may be performed substantially at the estimated arrival.

16 Claims, 2 Drawing Sheets

Related U.S. Application Data

(60) Provisional application No. 61/684,110, filed on Aug. 16, 2012.

(52) U.S. Cl.
CPC ..... *G07C 2009/00357* (2013.01); *G07C 2009/00769* (2013.01); *G07C 2209/04* (2013.01); *G07C 2209/63* (2013.01)

(56) References Cited

U.S. PATENT DOCUMENTS 6,147,622 A * 11/2000 Fonea ..... E05B 47/0642 235/380
6,728,351 B2 * 4/2004 Ahlstrom ..... H04M 11/025 379/102.06
6,778,068 B2 8/2004 Wolfe
7,315,823 B2 * 1/2008 Brondrup ..... G06Q 10/02 705/5
7,769,394 B1 * 8/2010 Zhu ..... H04M 1/72572 455/456.1
8,370,911 B1 2/2013 Mallard
8,570,143 B2 10/2013 Nakagawa et al.
8,662,386 B2 3/2014 Radicella et al.
8,825,021 B2 * 9/2014 Wang ..... H04W 4/02 340/5.2
8,902,042 B2 12/2014 Davis et al.
9,019,071 B1 4/2015 Mallard
2002/0147006 A1 10/2002 Coon et al.
2002/0183008 A1 12/2002 Menard et al.
2002/0196123 A1 12/2002 Diehl et al.
2003/0179075 A1 9/2003 Greenman
2005/0206498 A1 9/2005 Tsui et al.
2005/0284402 A1 12/2005 Becker
2007/0050259 A1 3/2007 Wesley
2008/0216156 A1 9/2008 Kosaka
2008/0278335 A1 11/2008 Welte
2008/0290990 A1 11/2008 Schaffzin et al.
2009/0163140 A1 6/2009 Packham et al.
2009/0167468 A1 7/2009 Dauer et al.
2009/0167488 A1 7/2009 Hays et al.
2010/0075656 A1 3/2010 Howarter et al.
2010/0126071 A1 5/2010 Hill
2010/0201536 A1 * 8/2010 Robertson ..... G07C 9/00904 340/686.6
2011/0084831 A1 4/2011 Tran
2011/0311052 A1 12/2011 Myers et al.
2012/0125261 A1 5/2012 Van Den Berg et al.
2012/0154115 A1 6/2012 Herrala
2012/0234058 A1 9/2012 Neil et al.
2012/0280789 A1 11/2012 Gerhardt et al.
2012/0303827 A1 * 11/2012 Neystadt ..... H04L 63/107 709/229
2013/0052990 A1 * 2/2013 Zhang ..... H04L 63/20 455/411
2013/0176107 A1 7/2013 Dumas et al.
2014/0049361 A1 2/2014 Ahearn et al.
2014/0049369 A1 2/2014 Ahearn et al.

FOREIGN PATENT DOCUMENTS

WO 2007079232 A2 7/2007
WO 2008056152 A1 5/2008

OTHER PUBLICATIONS

Mexican Office Action; Mexican Patent Office; Mexican Patent Application No. MX/a/2015/002067; dated Apr. 15, 2016; 3 pages.
International Search Report; International Searching Authority; International Patent Application No. PCT/US2013/055452; dated Feb. 5, 2014; 2 pages.
International Written Opinion; International Searching Authority; International Patent Application No. PCT/US2013/055452; dated Feb. 5, 2014; 7 pages.
European Examination Report; European Patent Office; European Patent Application No. 13829775.9; dated May 31, 2018; 6 pages.

* cited by examiner

USAGE OF GPS ON DOOR SECURITY

CROSS-REFERENCE TO RELATED APPLICATIONS

The present application claims the benefit of U.S. Provisional Patent Application No. 61/684,110 filed on Aug. 16, 2012, the contents of which are incorporated herein by reference in their entirety.

BACKGROUND

The disclosed embodiments generally pertain to locks, and particularly to smart lock systems.

SUMMARY

A lock system is provided with a smart lock that knows its specific location, and a wireless device with capabilities of utilizing location determining utilities, such as the Global Positioning System. The smart lock and the wireless device may be able to communicate between one another and send commands to and from one another to perform specific tasks when the wireless device is in a specified range of the smart lock.

BRIEF DESCRIPTION OF ILLUSTRATIONS

Embodiments of the invention are illustrated in the following illustrations.

DETAILED DESCRIPTION

Figure 1:
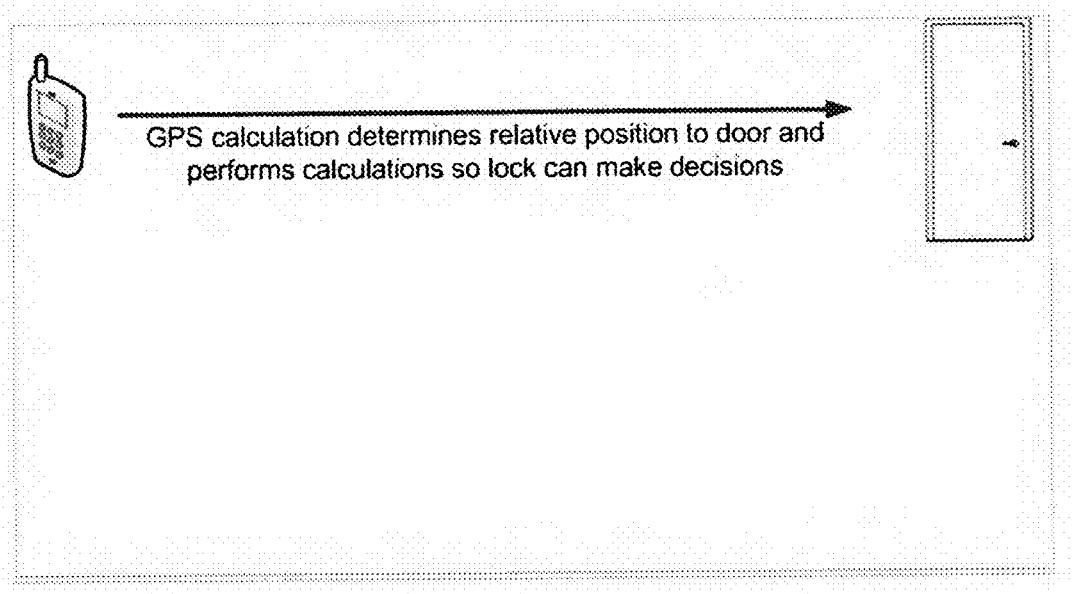
FIG. 1 is a schematic of a wireless device communicating with a lock so that the lock can make decisions.
Figure 2:
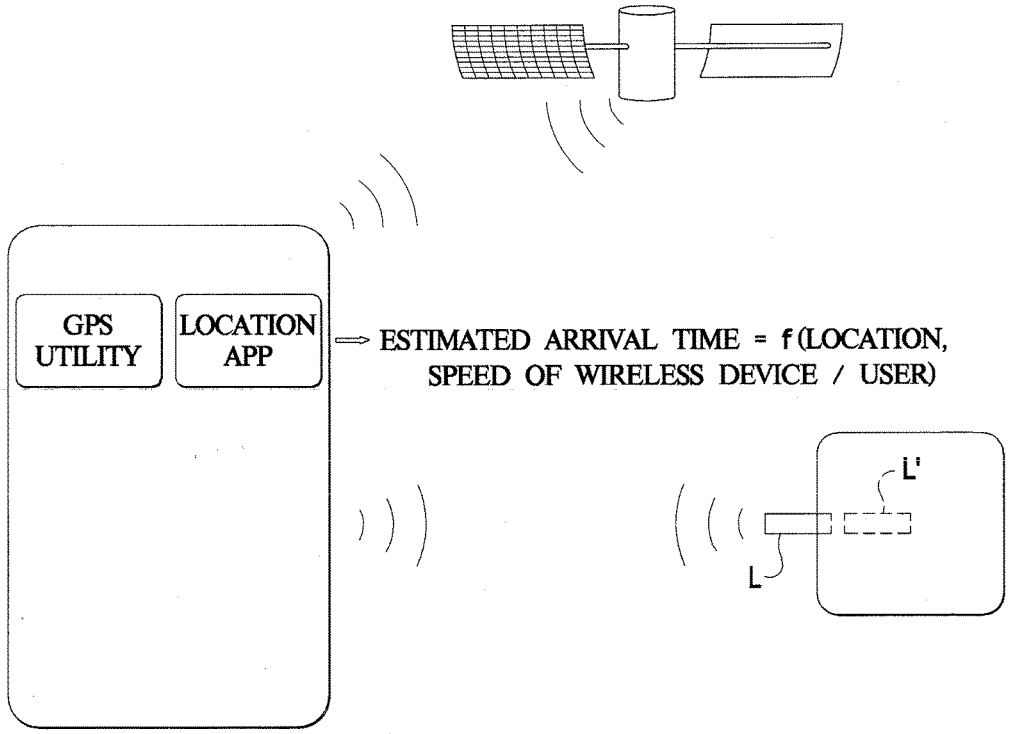
FIG. 2 is a schematic of an electronic lock and wireless device communication system.
Figure 3A:
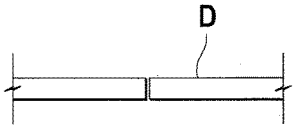
FIGS. 3A and 3B show a closed door and an open door, respectively.
Figure 3B:
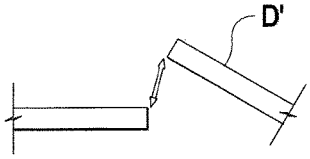

Referring to FIG. 1, a schematic of a wireless device, such as a smart phone, communicating with a lock so that the lock can make decisions is provided. As shown in FIG. 2, an application (or app) may be installed on the wireless device and may utilize a location determining utility, such as the Global Positioning System ("GPS"), to know the location of any given smart lock as well as the location of itself. In one non-limiting embodiment, the location and speed of the user, through the location and speed of the wireless device in the user's physical possession, can be used to calculate when the user will arrive at the associated lock. In some forms, the calculation is determined once the wireless device is in a given range of an associated lock. These features can then enable the lock to auto-unlock as the user arrives as shown in FIG. 2 with locked lock L and unlocked lock L'. Other functions may also be incorporated into the system, such as but not limited to automatically opening the door as shown by closed door D in FIG. 3A and open door D' in FIG. 3B, automatically closing the door behind the user as shown by open door D' in FIG. 3B and closed door D in FIG. 3A, locking the door behind the user as shown by lock L in FIG. 2, combinations thereof, and the like.

Use of location determining utilities, such as GPS, can actually be used for the phone application to determine if the app needs to actively search for locks to unlock. The app can know which sites' locks it is allow d to unlock, and if it is nowhere near those sites, then it can auto-disable to save battery life. For example, if a wireless device is out of range of any associated locks, then the installed app may stop looking for these associated locks and shut down to conserve battery life on the wireless device.

Use of location determining utilities can also allow certain commands to automatically be sent to the lock. For example if someone walks through their lock, the phone could be configured to auto-look the door (e.g. auto-privacy, auto-apartment, or other auto-"function") simply based upon who passes through a door and any custom configuration programmed into the app. In other additional and/or alternative examples, the lock may also be programmed to do different things when different wireless devices come through the door. For example, a lock may be programmed to auto-lock when a child's wireless device eaters the home, but not when an adult's wireless device enters the home.

Given the ability of a smart phone and; or credential to communicate relative position and speed, an estimate of when a user would need to interact with a lock can be calculated. This can enable the ability of not just auto-unlock, but also auto-open or any other automatic desired features.

Use of the GPS can be used for a wireless device, such as a smart phone, to determine if the app needs to actively search for locks to unlock. The app can know which sites' locks it is allowed to unlock, and if it is nowhere near those sites, then it can auto-disable and save battery life.

The GPS could be used during installation to automatically locate the lock and program it into the system. For example, after installation of the lock, the installer could set the lock up to have knowledge of its own location, either using the GPS or by programming.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments tacking the same may be contemplated as within the scope of the invention, the scope being defined by the claims that follow. In reading the claims, it is intended that when words such as "a" "an" "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A lock system, comprising:

an electronic lock associated with a door; and a wireless device having a location determining utility configured to determine a location of the wireless device; and wherein the electronic lock and the wireless device communicate wirelessly with one another and send commands to and from one another for the electronic lock to perform a specific task when the wireless device is within a specified range of the electronic lock, wherein the specific task comprises:

automatically unlocking the electronic lock as the wireless device comes within the specified range of the electronic lock;

automatically locking the electronic lock behind the wireless device after the wireless device passes through the door in response to determining the wireless device is associated with a first user; and leaving the electronic lock unlocked after the wireless device passes through the door in response to determining the wireless device is associated with a second user.

2. The lock system of claim 1, wherein the location determining utility comprises a GPS utility.

3. The lock system of claim 1, wherein the location of the wireless device and a speed of the wireless device are used to calculate an estimated arrival of the wireless device at the electronic lock.

4. The lock system of claim 3, wherein the automatically unlocking is performed substantially at the estimated arrival of the wireless device at the electronic lock.

5. The lock system of claim 1, wherein the specific task further comprises automatically opening or closing the door.

6. The lock system of claim 1, wherein the location determining utility comprises an application that is configured to actively search for one or more of the electronic lock and to know specific ones of the electronic lock the wireless device is permitted to unlock.

7. The lock system of claim 6, wherein the application auto-disables to save battery life if each of the specific ones of the electronic lock are out of range.

8. A lock system, comprising:

an electronic lock associated with a door; and a wireless device in wireless communication with the electronic lock and having a location determining utility configured to determine a location of the wireless device;

wherein the location of the wireless device relative to the electronic lock and a speed of the wireless device are used to calculate an estimated arrival of the wireless device at the electronic lock; and wherein a specific task is performed by the electronic lock substantially at the estimated arrival of the wireless device at the electronic lock, the specific task comprising:

automatically unlocking the electronic lock as the wireless device comes within the specified range of the electronic lock;

automatically locking the electronic lock behind the wireless device after the wireless device passes through the door in response to determining the wireless device is associated with a first user; and leaving the electronic lock unlocked after the wireless device passes through the door in response to determining the wireless device is associated with a second user.

9. The lock system of claim 8, wherein the location determining utility comprises a GPS utility.

10. The lock system of claim 8, wherein the specific task further comprises automatically opening or closing the door.

11. The lock system of claim 8, wherein the location determining utility comprises an application that is configured to actively search for one or more of the electronic lock and to know specific ones of the electronic lock the wireless device is permitted to unlock.

12. A method, comprising:

determining a first location associated with a wireless device;

comparing the first location to a second location associated with an electronic lock;

searching for the electronic lock with the wireless device in response to a result of the comparing indicating that the wireless device is within a first range of the electronic lock;

automatically unlocking the electronic lock as the wireless device comes within a second range of the electronic lock;

automatically locking the electronic lock behind the wireless device after the wireless device passes through a door associated with the electronic lock in response to determining the wireless device is associated with a first user; and leaving the electronic lock unlocked after the wireless device passes through the door in response to determining the wireless device is associated with a second user.

13. The method of claim 12, further comprising:

determining a speed of the wireless device; and calculating an estimated arrival time at which the wireless device will arrive at the electronic lock.

14. The method of claim 13, wherein automatically unlocking the electronic lock comprises unlocking the electronic lock substantially at the estimated arrival time.

15. The method of claim 13, wherein the calculating is performed in response to the result of the comparing indicating that the wireless device is within the first range of the electronic lock.

16. The method of claim 12, further comprising sending a command to the electronic lock via the wireless device in response to the result of the comparing indicating that the wireless device is within the first range of the electronic lock.

* * * * *